US005990797A

United States Patent [19]

Zlotchenko et al.

[11] Patent Number: 5,990,797

[45] Date of Patent: Nov. 23, 1999

[54] ULTRALOUD SMOKE DETECTOR

[75] Inventors: Eugene Zlotchenko, Buffalo Grove; Michael A. Swieboda, Naperville, both of Ill.

[73] Assignee: BKK Brands, Inc., Aurora, Ill.

[21] Appl. No.: 08/808,041

[22] Filed: Mar. 4, 1997

[51] Int. Cl.[6] ..... G08B 17/10

[52] U.S. Cl. ..... 340/628; 340/629; 340/630

[58] Field of Search ..... 340/628, 629, 340/527, 309.15, 328, 384.4, 384.6, 385.1, 630

[56] References Cited

U.S. PATENT DOCUMENTS

| | | | |
|---|---|---|---|
| 3,277,465 | 10/1966 | Potter | 340/384 |
| 3,798,625 | 3/1974 | McMillian et al. | 340/527 |
| 3,860,919 | 1/1975 | Aker | 340/527 |
| 3,890,612 | 6/1975 | Sweaney et al. | 340/384 |
| 3,940,919 | 3/1976 | Yasuda et al. | 58/38 R |
| 3,943,388 | 3/1976 | Massa | 310/8.2 |
| 4,079,271 | 3/1978 | Peil | 340/628 |
| 4,087,799 | 5/1978 | Brouwer | 340/630 |
| 4,104,628 | 8/1978 | Sweaney et al. | 340/384 E |
| 4,139,842 | 2/1979 | Fujita et al. | 340/384 |
| 4,159,472 | 6/1979 | Murrakami et al. | 340/384 R |
| 4,163,226 | 7/1979 | Ogawa | 340/629 |
| 4,222,046 | 9/1980 | Pinckaers et al. | 340/629 |
| 4,253,095 | 2/1981 | Schwarz et al. | 340/691 |
| 4,282,520 | 8/1981 | Shipp et al. | 340/629 |
| 4,306,229 | 12/1981 | Tamura et al. | 340/629 |
| 4,450,436 | 5/1984 | Massa | 340/531 |
| 4,459,037 | 7/1984 | Toyoda | 368/255 |
| 4,481,502 | 11/1984 | Dawson | 340/516 |
| 4,486,742 | 12/1984 | Kudo et al. | 340/384 E |
| 4,595,914 | 6/1986 | Siegel | 340/515 |
| 4,792,797 | 12/1988 | Tanguay et al. | 340/628 |
| 4,806,911 | 2/1989 | Petri | 340/574 |
| 4,926,159 | 5/1990 | Bartlett | 340/384 |
| 5,313,165 | 5/1994 | Brokaw | 324/414 |
| 5,444,434 | 8/1995 | Serby | 340/628 |

*Primary Examiner*—Daniel J. Wu
*Assistant Examiner*—Toan N. Pham
*Attorney, Agent, or Firm*—Rockey, Milnamow & Katz, Ltd.

[57] ABSTRACT

An ultraloud ambient condition detector incorporates a sensor in combination with a control circuit. An alarm indicating signal from the control circuit energizes a multi-frequency drive circuit which produces a band of output frequencies usable to drive a piezoelectric output element. The output element has one or more resonant frequencies which fall within the band of the drive frequencies. A feedback circuit is provided to maintain the unit in an alarm state, after it has switched into that state, even if the input ambient condition indicator signals a decline in the value of the sensed ambient condition or in the presence of noise perhaps generated by the audio output device. A high current, low duty cycle battery test current repetitively loads the battery consistent with current load when the detector is in an alarm state.

19 Claims, 6 Drawing Sheets

| FIG. 3A | FIG. 3B | FIG. 3C |
|---|---|---|

ULTRALOUD SMOKE DETECTOR

FIELD OF THE INVENTION

The invention pertains to ambient condition detectors. More particularly, the invention pertains to smoke detectors which generate ultraloud alarm indicating audible outputs when a predetermined level of smoke has been sensed.

BACKGROUND OF THE INVENTION

Smoke detectors have been recognized as being very useful and desirable in providing an early warning of dangerous levels of smoke, usually due to fire. When such detectors go into alarm, they usually generate an audible alarm indicating output. Such detectors can be expected to draw in the order of 6–10 mA of current when in an alarm state. Some detectors will generate a visual output as well.

Underwriter's Laboratories imposes a minimum standard requirement of 85 dBA output level for battery operated smoke detectors. A need has been identified to provide increased levels of alarm indicating audible inputs to benefit people with hearing losses. Increasing the output level by 10 dB produces a subjective effect for in individual in the region corresponding to doubling the level of the audio output.

There is thus an identified need for battery powered smoke detectors which will produce increased levels of audio output beyond those usually available with known detectors. Preferably, increased levels of audio output could be achieved without significant additional expense in either the components required or the manufacturing processes used to fabricate the detectors.

SUMMARY OF THE INVENTION

A low-cost, easy to install battery operated smoke detector incorporates features directed to people with hearing losses. The features include an increased minimum sound output level of 95 dBA. Lower frequency components have been added to the sound output as well. The lower frequency components are known to be perceptible by many people with hearing difficulties.

The detector includes an ambient condition sensor coupled to a control circuit. Sensors can include smoke, thermal, flame or gas sensors. Feedback elements across the control circuit reduce stuttering and hold the unit in an alarm state, once it enters alarm, even if there should be brief dips in the detected concentration of smoke or noise in the detector. In one aspect the feedback elements can include a capacitor and a resistor for altering a selected signal level so as to temporarily increase the sensitivity of the unit.

The detector is battery operated. The battery is regularly tested by a very low duty cycle, 0.5 millisecond pulse width, 100 milliamp test current on the order of every 45 seconds.

An alarm output of the control circuitry is used to energize drive circuitry which drives a piezo electric-type output element over a predetermined frequency band. This predetermined frequency band is intended to include one or more resonant points for the output unit thereby producing the desired very high levels of audible output.

Numerous other advantages and features of the present invention will become readily apparent from the following detailed description of the invention and the embodiments thereof, from the claims and from the accompanying drawings.

DETAILED DESCRIPTION OF THE PREFERRED EMBODIMENTS

Figure 1:
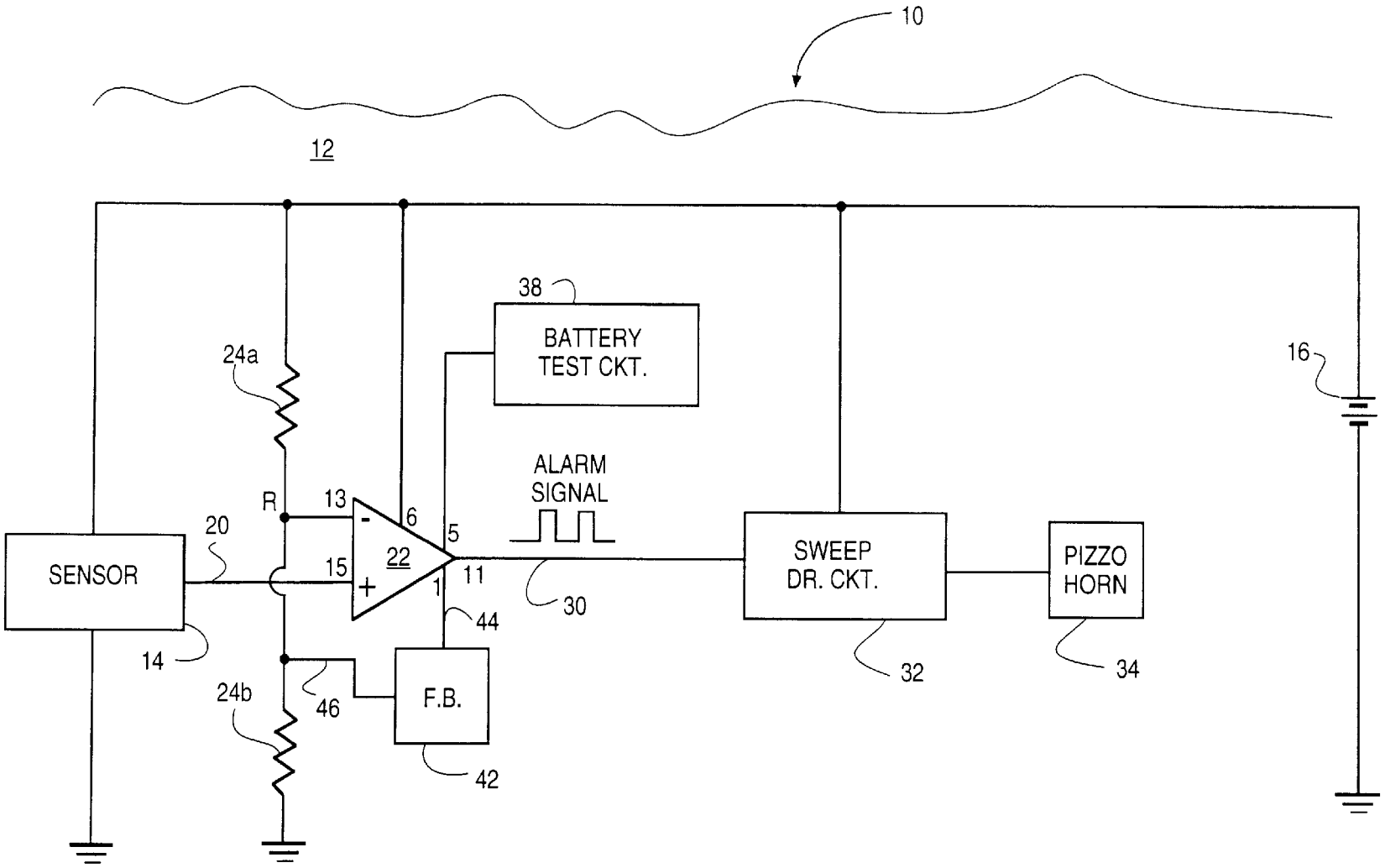
FIG. 1 is an overall block diagram of an ambient condition detector, which generates an ultraloud alarm output.

While this invention is susceptible of embodiment in many different forms, there are shown in the drawing and will be described herein in detail specific embodiments thereof with the understanding that the present disclosure is to be considered as an exemplification of the principles of the invention and is not intended to limit the invention to the specific embodiments illustrated.

FIG. 1 illustrates an ultraloud smoke detector 10 which incorporates a housing 12. The detector includes an ambient condition sensor 14, which could be for example an ionization or a photoelectric-type smoke sensor. Alternately, the detector 10 could incorporate a gas sensor or a heat sensor instead of a smoke sensor. A battery 16 energizes the sensor 14.

A level of smoke in the housing 12 is indicated by the sensor 14 as an electrical signal on the line 20. The output of the ambient condition sensor 14 on the line 20 is coupled to a smoke detector control circuit 22. A Motorola integrated circuit type SC41411PK, a commercially available product, could be used to implement the control circuit 22. Electrical characteristics of such integrated circuits, as would be known to those of skill in the art can be found in product data sheets and application notes published by Motorola.

Resistors 24*a*, 24*b* which are connected in series provide a reference input Vref at a node R. The node R is coupled to pin 13, a reference input of the control circuit 22. The voltage Vref in combination with the clear air output value from the sensor 14 on line 20, establishes the sensitivity of detector 10.

Sensor output voltage on the line 20 is coupled to pin 15 of the control unit 22. When the level of smoke, as indicated by an electrical signal on the line 20 exceeds the reference voltage at the node R, a pulse-type output signal is coupled to a line 30, from pin 11 of the control unit 22, and indicates the presence of an alarm condition.

The pulse-type signal on the line 30 enables sweep drive circuitry 32 which in turn energizes a piezoelectric horn 34 for the purpose of producing a high intensity ultraloud alarm signal having a minimum sound output level of 95 dBA. The drive circuitry 32 in addition to providing additional lower frequency components to the output sound also insures that the piezoelectric output horn 34 is driven at one or more resonant frequencies. This contributes to increased sound output to a minimum output level of 95 dBA. The drive circuitry 32 provides drive current on the order of 140 to 180 milliamps, at a minimum 7.5 volt battery output to produce the desired 95 dBA signal from the horn 34.

A battery test circuit 38 is coupled to pin 5 of control element 22 for purposes of generating a short battery test pulse. Because of the high current requirements of the horn 34 to produce the desired ultraloud output, the test current for the battery is applied on the order of every 45 seconds, with a very short duty cycle on the order of 0.5 milliseconds such that the life of the battery 40 is not adversely affected by the regular battery testing process. A load test current on the order of 100 milliamps, is coupled to the battery for the purpose of testing the condition of detector battery 16.

Figure 2:
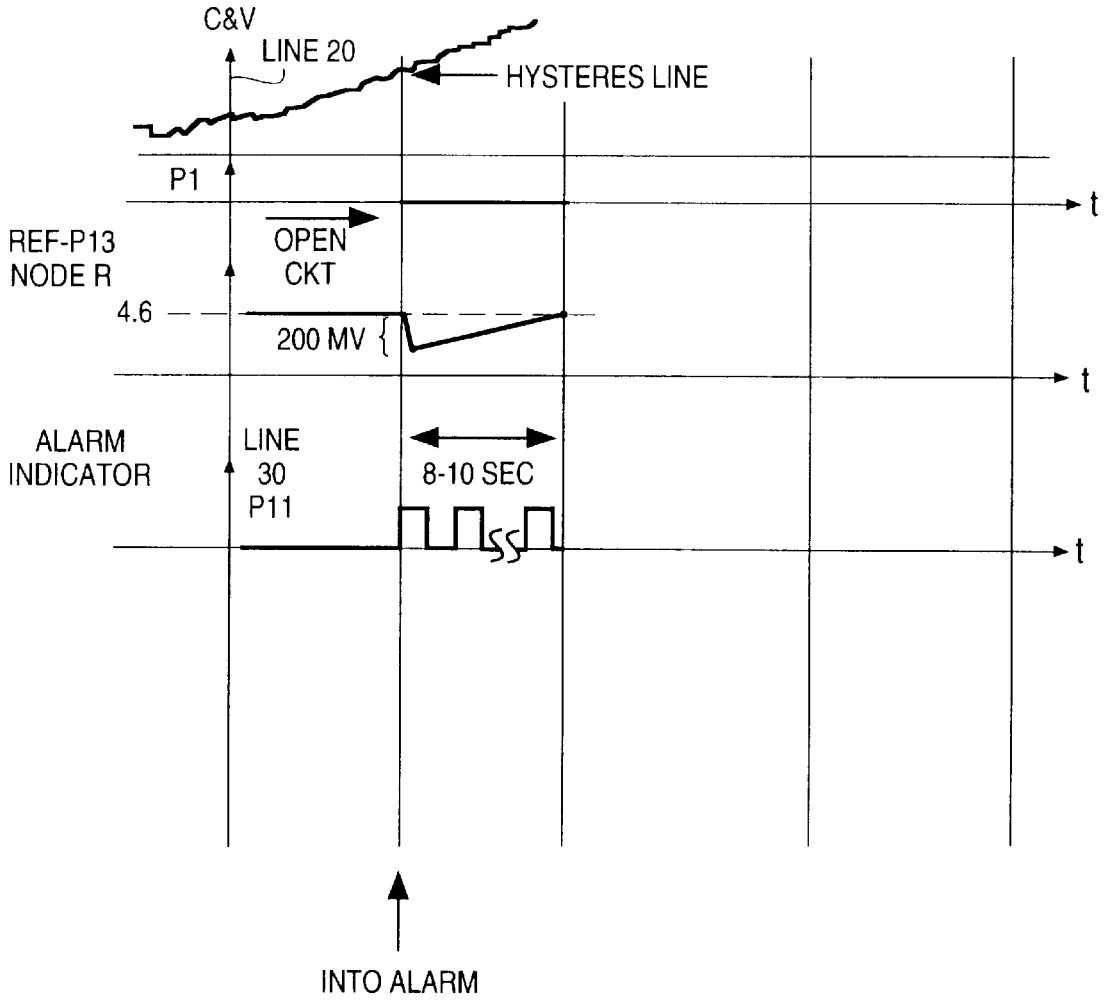
FIG. 2 is a set of timing diagram illustrating operation of the feedback circuitry.
Figures 3, 3A:
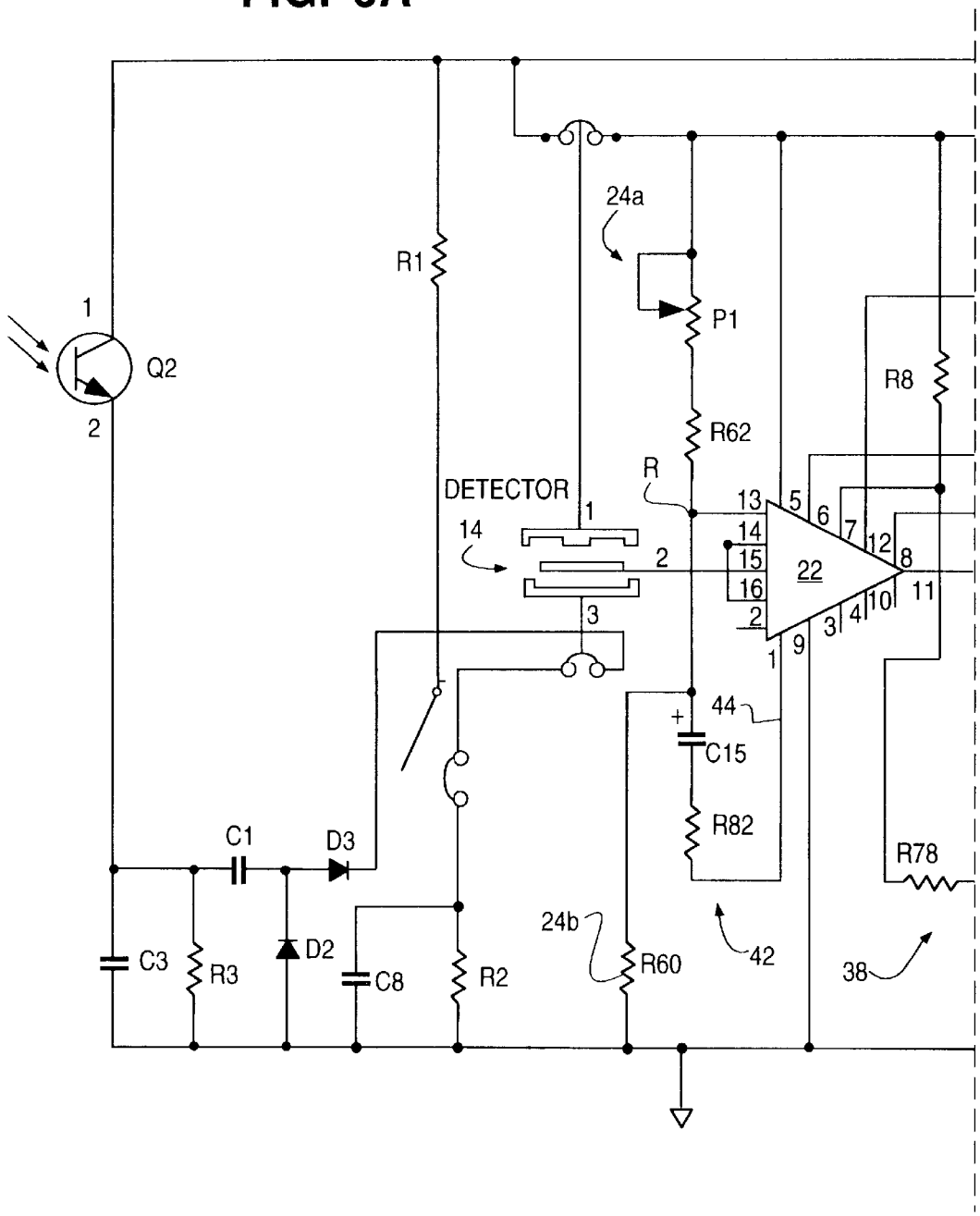
FIGS. 3A, 3B taken together represent a schematic diagram of the detector of FIG. 1.
Figure 3B:
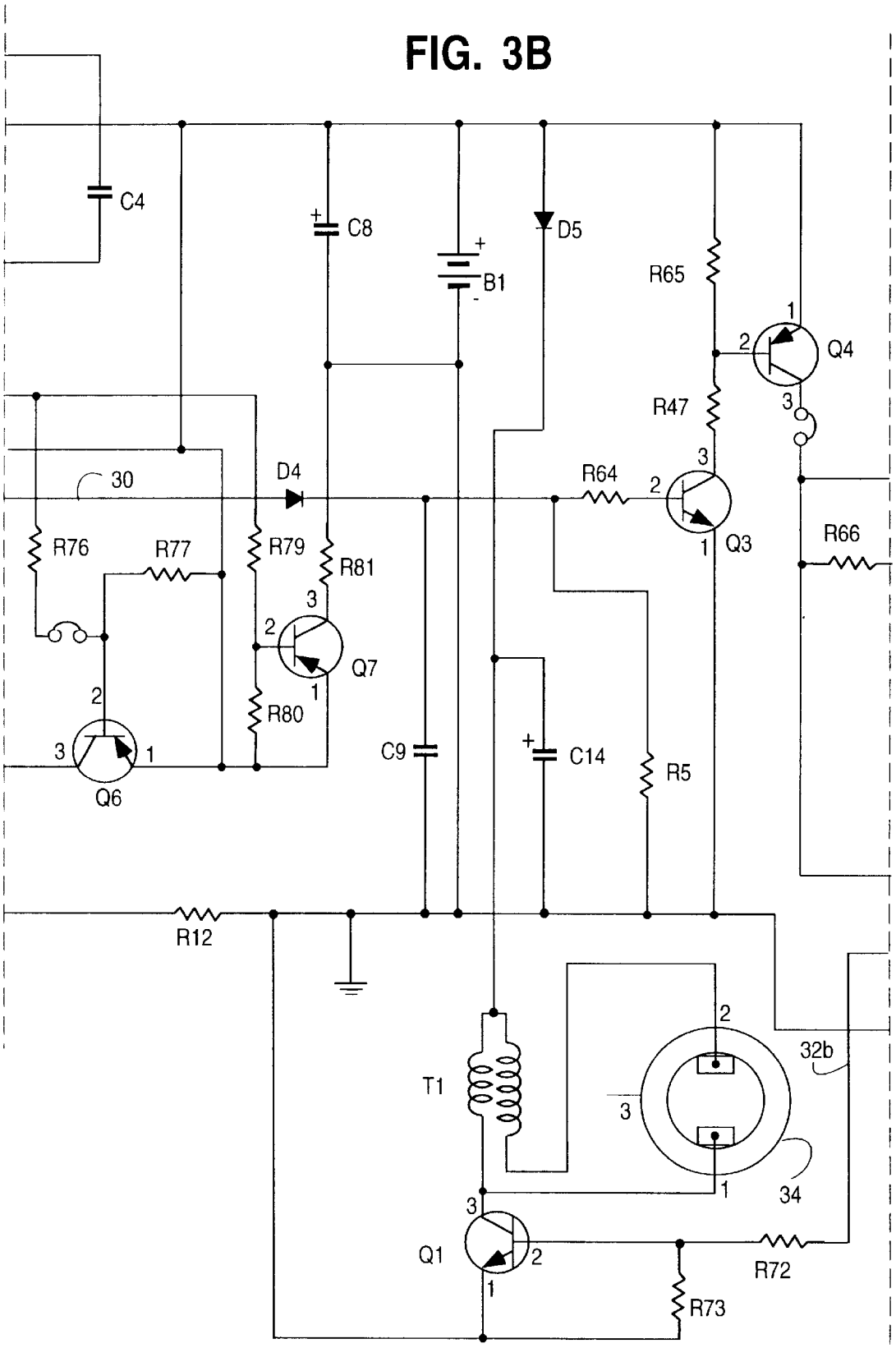
Figure 3C:
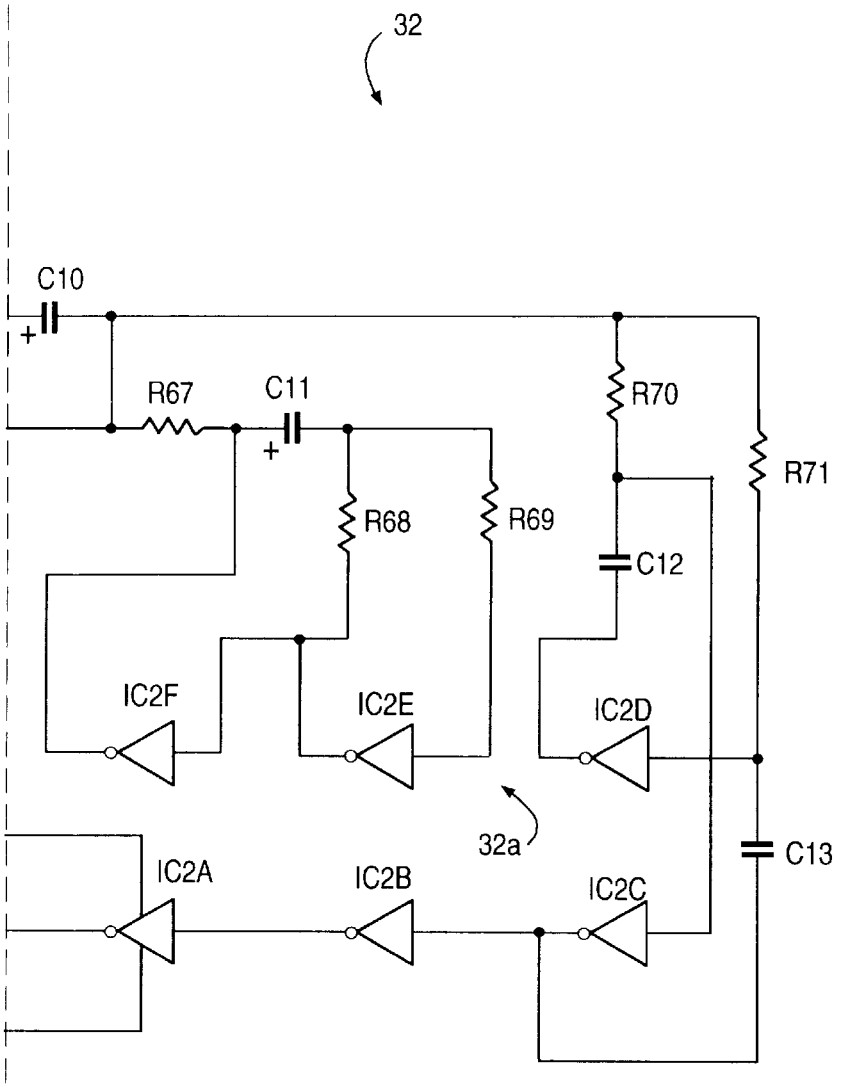

The detector 10 incorporates feedback circuitry 42 for the purpose of minimizing effects of noise which might be present in the detector 10 once the signal on the line 30 has gone high indicating the alarm condition. Feedback circuitry 42 temporarily increases the sensitivity of the detector 10 by decreasing Vref. FIG. 2 illustrates the operation of the circuitry 42.

When the signal on the line 30 goes high an open circuit at pin 1 of the control circuitry 22 is simultaneously grounded. A line 44, coupled to pin 1 applies a feedback control signal to the feedback circuitry 42. The feedback circuitry 42 in turn, on the line 46 reduces the voltage at the node R on the order of 200 millivolts for a brief period of time, 8 to 10 seconds.

The effect of the feedback circuitry 42 is to increase the sensitivity of the detector 10 and to force the control circuitry 22 to stay in the alarm state even if noise is present in the detector 10 or even in the presence of a temporary decrease in the level of smoke, as indicated on the line 20 from the sensor 14.

Circuitry 42 will not permit the detector 10 to go out of alarm until the 8 to 10 second time interval has passed. In most instances, the signal on the line 20 will continue to increase due to increasing smoke in the region being supervised by the detector 10. Hence, notwithstanding the recovery of the sensitivity and the reference signal at the node R to their normal values, the voltage on the line 20, more likely than not, will have increased sufficiently to continue to keep the control circuitry 22 in an alarm state until the source of the smoke, gas or heat or the like (depending on the exact nature of the sensor 14) is addressed.

More specifically, a comparator built into the control unit 22 compares the reference voltage Vref, at node R (pin 13) with voltage coming from sensor 14 to pin 15 (CEV). The reference voltage is determined by resistor string R60, R62 and P1, and set approximately 1V higher than CEV in clear air. The CEV increases with smoke obscuration. Once the voltage on the line 20 becomes equal to Vref the detector 10 goes into alarm.

Electrical nose and fluctuations of Vref due to large currents drawn by horn 34 cause alarm hesitations when smoke is detected. The feedback circuit 42 which incorporates resistor R82 and capacitor C15 minimizes this problem. When the control circuit 22 goes to alarm pin 1 goes low. This grounds one end of resistor R82 which reduces Vref by about 200 mV. As illustrated in FIG. 2 as the capacitor C15 charges, the voltage Vref recovers to its normal value. Detector 10 is locked in alarm state during this time interval.

When smoke is detected, control circuit generates the previously described pulse-type signal at pin 11, line 30. This signal is applied directly to a rectifier diode D4, through which a capacitor C9 is charged. Diode D4 prevents discharge of capacitor C9 during the off cycle of the alarm indicating pulse signal on line 30. Resistor R5 acts as a discharge path for capacitor C9 and a pull-down resistor for transistor Q3 so that when no alarm indicating signal is applied, transistor Q3 remains fully off. As such, the circuit draws negligible current when not in an alarm state.

The DC voltage on capacitor C9 is applied through base resistor R64 to the base of NPN Bipolar transistor Q3, which is connected in a Darlington configuration with PNP Bipolar transistor Q4. Pull-up resistor R65 keeps transistor Q4 cut-off when the detector 10 is not in alarm and no signal is present on line 30. In the presence of the rectified voltage at the base of transistor Q3, Q3 conducts and pulses the base transistor of Q4 low, turning on Q4. The high current gain of Q3 and Q4 ensures that Q4 is fully saturated when it is turned on.

When transistor Q4 is on, battery voltage is applied to the circuit of IC2 (hex inverters) and the associated RC network and the frequency sweeping oscillator 32*a* is activated. The sweep frequency range of the oscillator 32*a* can be adjusted by changing the RC combination of R70 and C12 and/or the RC combination of R71 and C13.

The frequency range in the illustrated embodiment can be adjusted to approximately 2 kHz to 4 kHz. This range corresponds to the frequency range that yields the highest sound output level exhibited by Motorola-type KSN1179A piezo horn 34. The sweep rate, which for example could be set to approximately 9 Hz, can be changed by adjusting the RC combination of resistor R68 and capacitor C11.

Piezo crystal devices such as the horn 34 exhibit a very narrow resonant frequency band or bands such that loud output is achieved when excited by an external driver circuit only when the external driver circuit oscillates at a frequency within this narrow band or bands. Moreover, sound output power drops off dramatically when the piezo device is driven at a frequency not far outside these bands. For example, typical tolerance specifications on the resonant frequency RF of these piezo crystals devices are ±500 Hz. With these limitations, it is clear that a repeatable product of consistent performance and quality could be mass produced only with some difficulty. This process might involve a delicate factory calibration likely to be costly, time consuming and subject to human error.

The oscillator arrangement of detector 10 alleviates the above described problems and exhibits other favorable characteristics. These results are achieved by exciting the piezo horn over a range of frequencies selected to ensure that the resonant bands of the horn are included. These additional favorable characteristics include a distinctive "warble" sound that is readily distinguished from other smoke detector alarms. Also, it is known that sound abruptly varying in frequency such as the sound produced by detector 10 is more easily perceived by those with hearing losses.

The output of the oscillator 32*a* on line 32*b* is a square wave that linearly or approximately linearly increases and decreases in frequency from about 200 Hz to about 4000 Hz at a rate of about 9 Hz. This wide band of frequencies is needed to ensure that the piezo horn 34 is excited within it's resonant frequency band at some point during the frequency sweep. It has been also chosen to correspond to the frequency range of highest sound output exhibited by the horn 34, thus satisfying requirements for a loud output.

If a different horn is used, instead of the Motorola KSN1179A, then the frequency response for the new horn will need to be determined in order to ensure that the frequency sweep of the oscillator is appropriate for efficient and consistent loud output. If necessary, the sweep range can be adjusted as described previously.

The frequency modulated square wave on line 32*b* is applied through base resistor R72 to the base of NPN Bipolar transistor Q1. Transistor Q1 is biased in the common emitter configuration through the primary side of a step up autotransformer T1. Biased as illustrated, transistor Q1 will switch fully on and fully off at the varying oscillator rate. This produces a large di/dt through the primary side of transformer T1 and inductively generates a primary voltage varying from zero volts to approximately twice the supply voltage. This primary voltage is stepped up across transformer T1 resulting in a peak voltage on the order of approximately 50 to 60 volts across the secondary of T1 which is applied to the piezo horn 34. Resistor R73 acts as a pull-down resistor to keep transistor Q1 turned off unless activated by the oscillator, thereby holding the off-state current to a negligible value.

Unlike prior art detectors, the detector 10 draws on the order of 120 to 180 mA of current when in an alarm state. This large current is required to drive the horn 34 to produce the desired 95 dBA output level. This large current also requires a compatible battery test circuit and method.

In order to make an accurate assessment of the condition of the battery 16, a short duration battery load test at a current comparable to the alarm state current of the detector 10 is carried out periodically. The loaded battery voltage is compared to a low battery reference value by way of a comparator in control circuit 22. The low battery voltage reference is also set internally.

Figure 4:
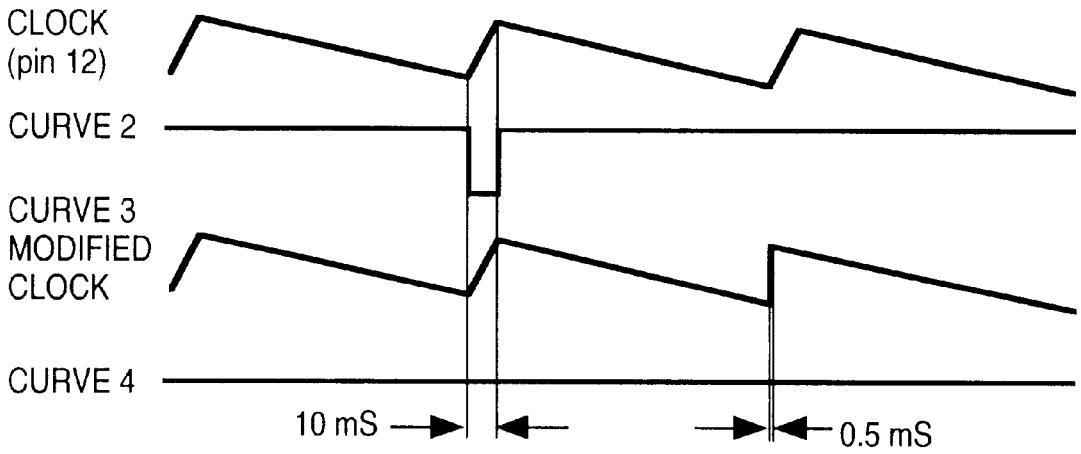
FIG. 4 is a set of timing diagrams illustrating some aspects of operation of the battery test circuitry.

The following arrangement is suitable for prior art detectors that require less than 10 mA of current. To check the battery, a small load is placed on the battery by way of pin 5 and load resistor R17. Pin 5 is switched low for about 10 mS at an interval of about 45 seconds (FIG. 4, curve 2). With a low voltage on pin 5, load current is sinked through the control circuit 22, and the loaded battery voltage is compared to the reference. The output of the on-chip comparator, which is low for a battery below the reference, and high for a battery above the reference, is latched on the low to high transition of pin 5.

Unlike the prior art detectors, the detector 10 requires a load test current of about 80 to 120 mA. Since the circuit 22 is specified to sink only up to 10 mA at pin 5, an external load circuit consisting of transistors Q6, Q7 and associated circuitry has been added to carry out an appropriate battery test. Also, as illustrated in FIG. 4., in order to preserve battery life, the clock period has been shorted (curve 3) during the low out on pin 5 in order to shorten the 10 mS load test to about 0.5 mS (curve 4). A short duration, high current pulse results in a battery voltage dip that is reliable as a battery status indication.

The clock period of control circuit 22, is determined by resistor R8 and capacitor C4. When pin 5 is switched to ground, the base of transistor Q6, via resistor 76, is pulled low and Q6 is turned on. With Q6 turned on, resistor R78 is switched in parallel with R8, resulting in a parallel combination of about 320K, which shortens the clock period by a factor of twenty.

The low impedance present at pin 5 is also applied to resistor R79, part of the biasing network associated with transistor Q7. This turns Q7 on for the now shortened load test period of about 0.5 mS. A high current load test pulse of about 80 to 120 mA is simultaneously applied to the battery 14. The battery voltage is compared to a reference internal to circuit 22 and the result is latched in the same manner as described previously. Transistor Q7 internal to circuit 22 is held in the off-state by pull-up resistor R80.

Schottky diode D5 isolates capacitor C14 from the battery load test current. Without D5, the load current pulse would simply discharge C14 without placing the desired load on the battery itself.

In the presence of a loaded battery voltage that is at or below the preset reference, as described above, the piezo horn 34 issues a short duration square pulse every 30 to 52 seconds. This pulse is applied to line 30 in exactly the same manner as described above. The result is an activation of the alarm for a short period serving as a low battery indication. The duration of this low battery "chirp" is determined primarily by the RC time constant of R5 and C9.

From the foregoing, it will be observed that numerous variations and modifications may be effected without departing from the spirit and scope of the invention. It is to be understood that no limitation with respect to the specific apparatus illustrated herein is intended or should be inferred. It is, of course, intended to cover by the appended claims all such modifications as fall within the scope of the claims.

What is claimed:

1. An ambient condition detector comprising:

a housing;

an ambient condition sensor carried by the housing;

a control circuit, coupled to the sensor, for determining if a selected condition has been indicated by the sensor and for establishing an alarm indicating signal in response thereto wherein the control circuit includes a feedback circuit for increasing the sensitivity of the detector for a predetermined period of time in response to the control circuit having established the alarm indicating signal.

2. A detector as in claim 1 wherein the feedback circuit includes a resistor coupled to a capacitor.

3. A detector as in claim 1 wherein the control circuit includes a sensor input port coupled to the sensor and a threshold input port coupled to a threshold establishing circuit.

4. A detector as in claim 3 wherein the control circuit includes an output port for providing an electrical signal indicative of the alarm state with the feedback circuit coupled between the electrical signal and one of the input ports.

5. A detector as in claim 4 which includes an audible output device coupled to the control circuit for producing an audible indicator of the alarm state.

6. A detector as in claim 5 wherein the control circuitry includes electrical sweep circuitry, coupled to the output device wherein the sweep circuitry generates at least one sweep signal for energizing the output device at a plurality of different frequencies.

7. A detector as in claim 6 which includes battery test circuitry and wherein the battery test circuitry includes test current generation circuits for providing a test current pulse with an amplitude in excess of 50 mA.

8. A detector as in claim 7 wherein the test pulse current has a repetition rate in a range of 30 to 52 sec.

9. A detector as in claim 7 wherein the test pulse current has a width on the order of 0.5 mSec.

10. A detector as in claim 6 which includes battery test circuitry and wherein the battery test circuitry includes test current generation circuits for providing a test current pulse with an amplitude of 70–140 mA.

11. A detector as in claim 10 wherein the test pulse current has a width in a range of 0.3 to 0.7 mSec.

12. A detector as in claim 6 wherein the sweep circuitry includes circuitry for generating the sweep signals at a predetermined rate.

13. A detector as in claim 12 wherein the output device incorporates a vibrating, solid state element having at least one resonant frequency and wherein the sweep signal incorporates a band of frequencies with the one resonant frequency therein.

14. A detector as in claim 13 wherein the vibratory solid state element includes a piezoelectric component.

15. A detector as in claim 1 wherein the feedback circuit includes a resistor-capacitor combination which increases the sensitivity for a time interval in a range of 5–15 seconds.

16. An ultraloud smoke detector comprising:

a smoke sensor;

a control circuit having a preselected sensitivity, coupled to the smoke sensor, for actuating an alarm by generating a signal indicative of a predetermined level of smoke;

a multi-frequency signal generator coupled to the control circuit for repetitively generating a band of frequencies when activated in response to the predetermined level of smoke;

an audible output device, coupled to the generator, having at least one resonant frequency in the band of frequencies; and a feedback circuit, coupled across the control circuit and responsive to the smoke indicative signal for temporarily increasing the sensitivity in response to the presence of the smoke indicative signal.

17. A detector as in claim 16 wherein the feedback circuit includes a resistor-capacitor combination which increases the sensitivity for a time interval that exceeds 5 seconds.

18. A variable sensitivity ambient condition detector comprising:

a sensor;

a comparator having two inputs and an output wherein one input is coupled to the sensor and wherein the output goes from a first state to a second state, actuating an alarm, in response to the inputs assuming a predetermined relationship indicative of a first sensitivity level;

a threshold establishing circuit with a threshold node coupled to the other input and wherein the circuit establishes a quiescent threshold value at the node; and an R-C type threshold altering circuit coupled between the output of the comparator and the threshold node wherein in response to the sensor generating a signal indicating the presence of a selected condition and the output of the comparator going from the first state to the second state, in response thereto, the quiescent value is altered to temporarily increase the sensitivity from the first level to a second, more sensitive, level thereby temporarily holding the comparator in the second state even in the presence of transient variations in the signal generated by the sensor.

19. A detector as in claim 18 wherein the threshold altering circuit includes a resistor-capacitor combination which increases the sensitivity for a time interval that exceeds 5 seconds.

* * * * *